US008123586B2

(12) United States Patent
Dell

(10) Patent No.: US 8,123,586 B2
(45) Date of Patent: Feb. 28, 2012

(54) ELECTRONIC JUMP ROPE

(75) Inventor: George Dell, Grayslake, IL (US)

(73) Assignee: Dell Electronics Laboratories, Ltd., Grayslake, IL (US)

( * ) Notice: Subject to any disclaimer, the term of this patent is extended or adjusted under 35 U.S.C. 154(b) by 1087 days.

(21) Appl. No.: 11/796,864

(22) Filed: Apr. 28, 2007

(65) Prior Publication Data

US 2008/0268949 A1 Oct. 30, 2008

(51) Int. Cl.
*A63H 1/00* (2006.01)

(52) U.S. Cl. ..... 446/236; 463/7; 482/54

(58) Field of Classification Search ..... 463/1, 31; 446/236; 473/414; 84/743; 482/54
See application file for complete search history.

(56) References Cited

U.S. PATENT DOCUMENTS 5,839,976 A * 11/1998 Darr ..... 473/414
6,001,013 A * 12/1999 Ota ..... 463/7
6,227,968 B1 * 5/2001 Suzuki et al. ..... 463/7
6,450,888 B1 * 9/2002 Takase et al. ..... 463/43
6,554,706 B2 * 4/2003 Kim et al. ..... 463/36
6,663,491 B2 * 12/2003 Watabe et al. ..... 463/36
6,835,887 B2 * 12/2004 Devecka ..... 84/743
7,367,887 B2 * 5/2008 Watabe et al. ..... 463/36
2005/0255787 A1 * 11/2005 Pak ..... 446/236
2006/0142127 A1 * 6/2006 Wilkins et al. ..... 482/54
2007/0032353 A1 * 2/2007 Wilkins et al. ..... 482/54

OTHER PUBLICATIONS

Jumpin Jackpot Manual Dated Nov. 2006 with the attached Picture.*

* cited by examiner

*Primary Examiner* — Masud Ahmed
(74) *Attorney, Agent, or Firm* — Knechtel, Demeur & Samlan

(57) ABSTRACT

An exercise gaming device in which the user stands in front of a housing having a plurality of rows of lights extending from the front of the housing to the rear of the housing. The rows of lights are sequentially illuminated to give the illusion that the lights are an illuminated light rope over which the user must jump. There is a sensor in the jump area that is electrically connected to the illuminated lights to determine if the user jumps at the correct time when the lights at the bottom of the housing are illuminated. The device continues to rotate the light rope as long as the user continues jumping at the appropriate time, or until the game ends.

18 Claims, 6 Drawing Sheets

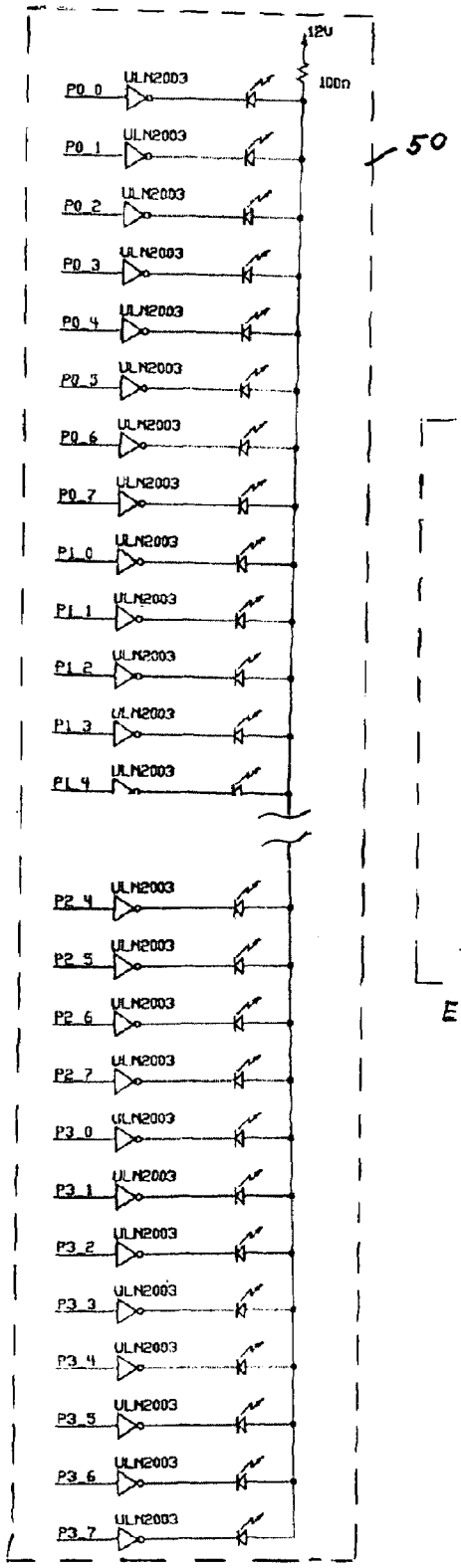
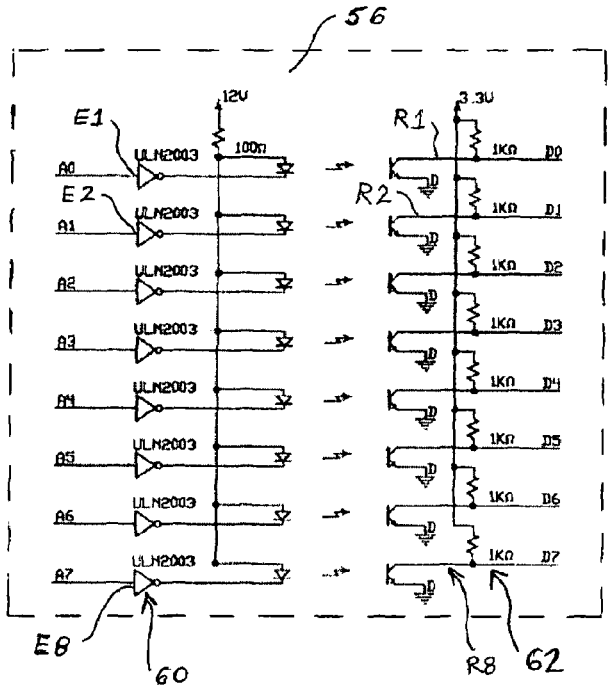
Fig. 4B
Fig. 4A

ELECTRONIC JUMP ROPE

I. FIELD OF THE INVENTION

The present invention relates to interactive electronic games and, more particularly, to an electronic game that simulates the natural rotation and path that a jump rope will typically travel as viewed from the perspective of the jumper or user and provides an interactive means for the jumper or user to make an actual jump over the electronic jump rope.

II. BACKGROUND AND SUMMARY OF THE INVENTION

Various interactive electronic games have been invented in the past. Some involve the user operating a controller, control stick, gun, steering wheel, or other control device for the user to interact with the game. Other games require the user to perform a physical activity to play the game. Examples are where the user stands on a board and watch a video display of surfing, sitting on a model of a motorcycle and shifting the user's weight to simulate turns, and those in which the user must exert a force or lift a weight against a sensor that measures the strength of the user and charts it against a specific goal. Another type if game is one in which the user must time a physical activity against a moving object or target. This is the type of game which Applicant's invention addresses. The game can also be used as an exercise apparatus in health clubs or at home to simulate jumping rope. Thus the invention is intended to encompass both an interactive electronic game and exercise device.

In Applicant's game the user must jump over a virtual rope in order to score points. The rope is comprised of a series of strings of lights that are placed around the perimeter of an oval shaped housing. Each of the strings of lights is comprised of a series of light emitting diodes connected together. The individual strings of lights are illuminated sequentially to give the illusion that the rope is moving around the perimeter of the housing.

The user stands on a platform or jump pad in front of the housing. As the light rope moves around the housing, the user must jump off of the platform as the light string passes beneath the user. If the user successfully jumps as the light string passes beneath the user, the rope continues rotating around the housing. If the user does not jump as the light string passes beneath the user, the game ends. Sensors in the platform are connected to their respective light string so that the controller determines if the user is off the platform at the precise time that the light string is illuminated. The game continues so long as the user successfully jumps over the light string or until a predetermined time or number of jumps is achieved.

There are provisions in the control circuit so that a user cannot remain off of the platform for more than a predetermined time or the controller will know that the user is not jumping on the platform and playing the game according to the rules. In this event the game ends just as though the user did not jump over the rope.

III. BRIEF DESCRIPTION OF THE DRAWINGS

The Description of the Preferred Embodiment will be better understood with reference to the following figures:

FIGS. 4A-4D are electronic schematics illustrating several components of the electronic jump rope device.

IV. DETAILED DESCRIPTION OF THE PREFERRED EMBODIMENT

Figure 1:
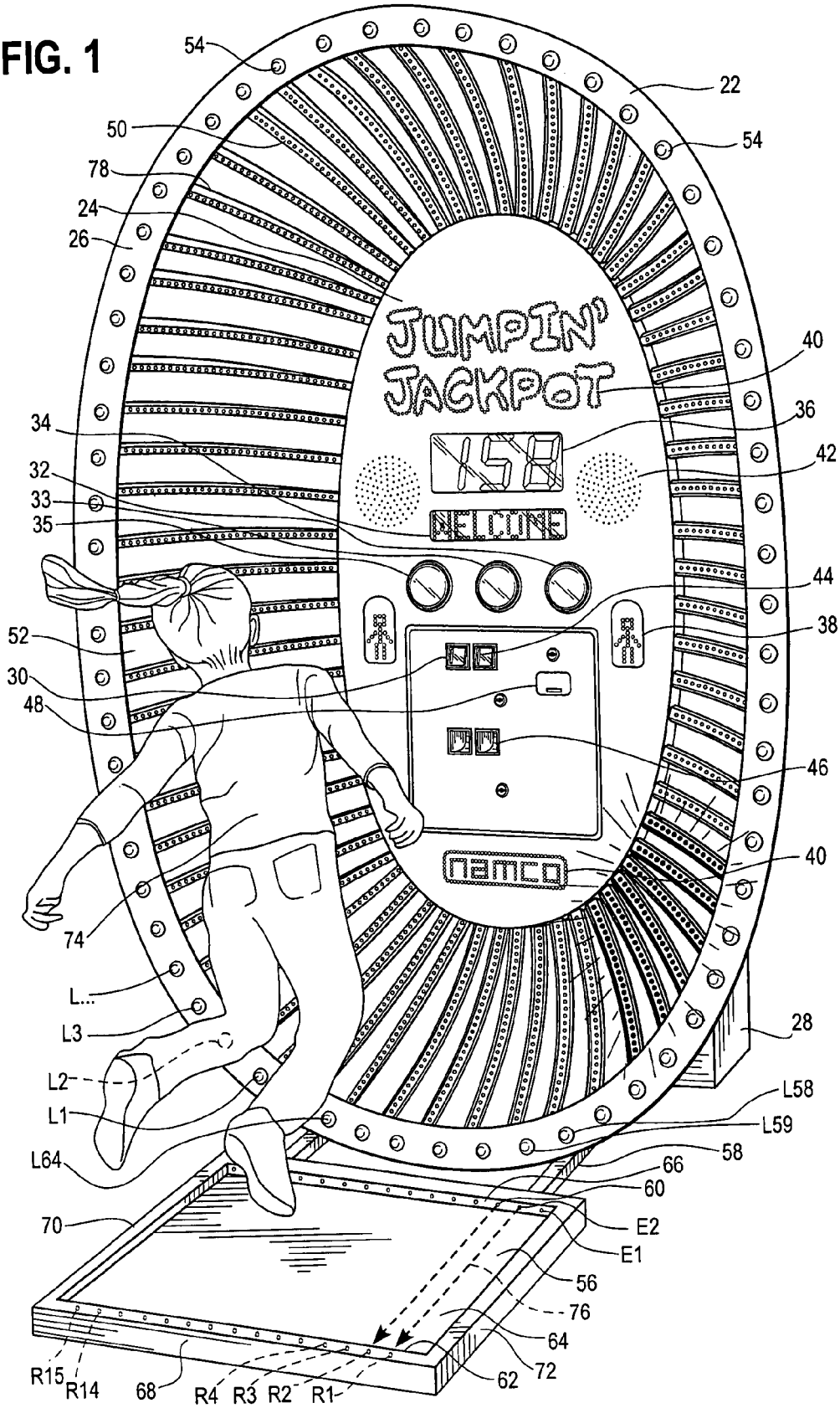
FIG. 1 is a front perspective view of Applicant's electronic jump rope device.

Turning first to FIG. 1, Applicant's electronic jump rope device 20 is illustrated. The device 20 comprises a housing 22. In the preferred embodiment, the housing 22 is an egg shaped, plastic shell that is approximately seventy-eight inches (78") in height and fifty-two inches (52") in width. The size and shape of the housing 22 is designed such that it can most accurately simulate the natural rotation and path that a jump rope will typically travel as viewed from the perspective of the user. This is preferably a circle. Alternatively, the housing 22 may be an oval, elipse or egg shape or any size or shape as desired and/or made of any structure known to one skilled in the art sufficient to accomplish the invention as described herein.

The housing 22 is comprised of a display board unit 24, a frame 26, and a support base 28. Individual strings of lights 50 extend from the display board unit 24 to the frame 26. In the preferred embodiment, each individual string of lights 50 contains approximately thirty-one (31) individual light emitting diode lights 54 with each light 54 electrically connected to one another to form this single string of lights 50 between the display board unit 24 and the frame 26. Alternatively, each or any individual string of lights 50 may contain as few as one single light 54, as many lights 54 as desired, or as feasible to one of ordinary skill in the art. Also, each individual string of lights 50 may be encased within a protective flexible plastic casing 78 or a hard, transparent covering.

There are approximately sixty-four (64) individual strings of lights 50 that extend from the display board unit 24 to the frame 26 around the entire perimeter of the housing 22. Alternatively, the total number of individual strings of lights 50 that extend around the entire perimeter of the housing 22 may be larger or smaller as desired provided that it accomplishes the invention as described herein. As a further alternative, it is contemplated that all of the individual strings of lights 50 around the entire perimeter of the housing 22 may be combined into a single light that is illuminated in the same rotational manner as described in more detail below. The lights 54 mounted in the front of the housing around the perimeter of the housing 22 form a continuous light path.

In the preferred embodiment, the height and width of the frame 26 is larger than the height and width of the display board unit 24. This size differentiation enables every light 54 in each individual string of lights 50 surrounding the perimeter of the housing 22 to be visible when in use. The frame 26 is also provided with an opening 52 adjacent to each string of lights 50 to enable the illumination of the lights 54 closest to the frame 26 to be also seen by the user 74.

The display board unit 24 comprises a game activated mechanism 30, game selection displays 32, 33, and 35, a message display 34, a time/score display 36, a user display 38, illuminated indicia 40, and a set of speakers 42.

The game activated mechanism 30 consists of a coin slot 44 for receiving coins to pay for a game selected and a coin return 46 for returning coins in excess of the fee for the game selected or coins not accepted as proper payment. In the preferred embodiment, the game activated mechanism 30 is any coin-operated mechanism that is known to one skilled in the art. A ticket dispenser 48 for dispensing paper tickets or other rewards for game performance is also provided adjacent to the coin slot 44.

The game selection displays 32, 33, and 35 are used to indicate the skill level of the jump rope game selected. In a non-limiting example, level 1 of the game is indicated by the game selection display 32, level 2 of the game is indicated by the game selection display 33, and level 3 of the game is indicated by the game selection display 35. Alternatively, it is contemplated that fewer or more game selection displays may be provided depending upon the number and types of levels of the game desired. In the preferred embodiment, each level of the game is pre-programmed with certain game information. This game information includes but is not limited to a time duration ("Time"), a total number of jump rope rotations or turns ("Number of Rope Turns"), the speed of the jump rope for each rope rotation or turn ("Speed of Rope Turn"), and whether that speed is to increase or decrease based on a number of jumps successfully completed or other parameters ("Performance Enhancer"), and any other desired information.

A platform 56 is attached to the housing 22 using connecting arms 58. The platform 56 has a top surface 64, a proximal end 66 adjacent to the housing 22, a distal end 68 on the opposite side of the platform 56 from the proximal end 66, and opposed sides 70 and 72. The platform 56 is also provided with emitters 60, located in the proximal end 66, and receivers 62, located in the distal end 68.

Figure 2:
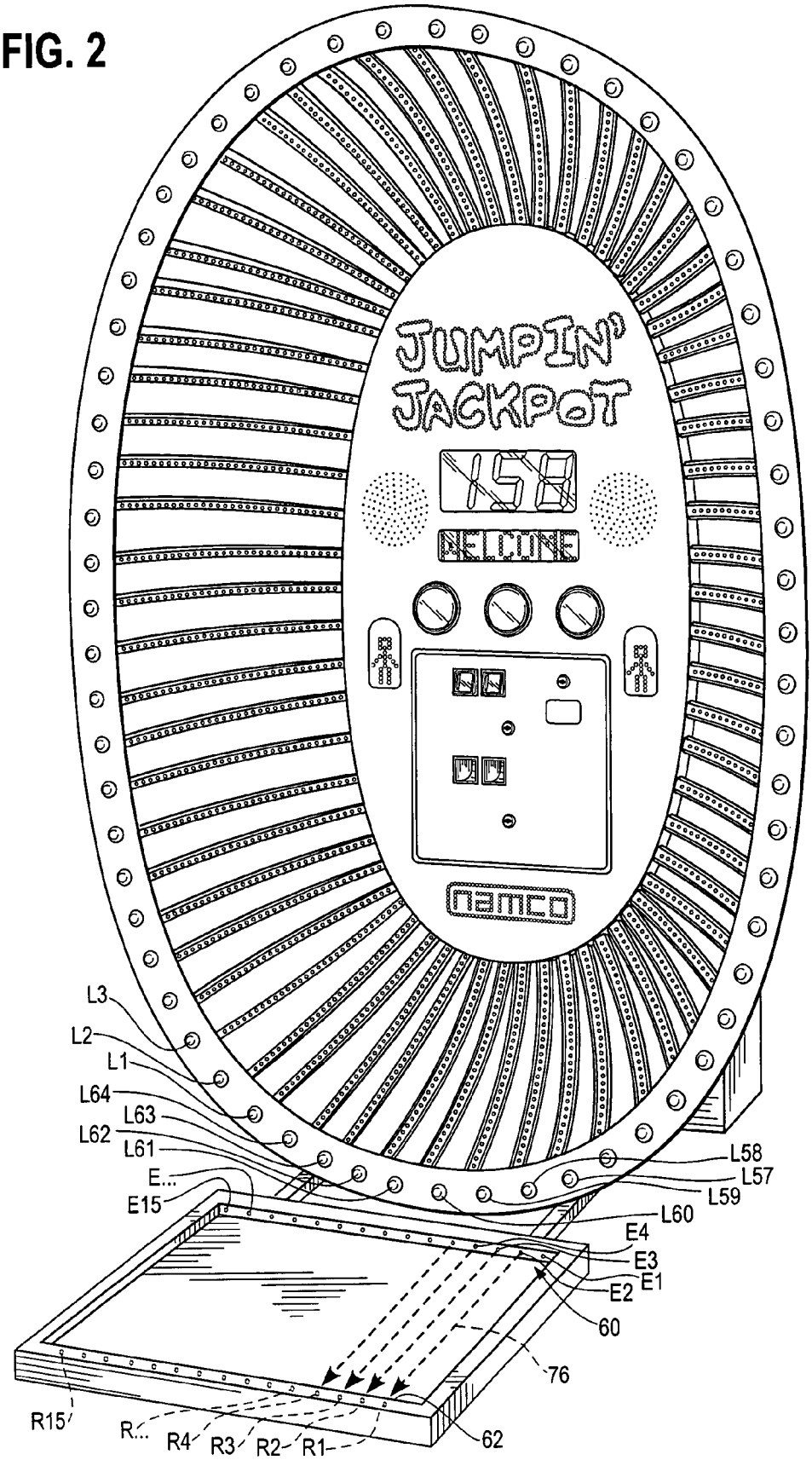
FIG. 2 is a front perspective view of the electronic jump rope device and providing specific references to various components of the device.

Referring to FIG. 2, the emitters 60 are individually positioned lengthwise along the proximal end 66 and are identified by references E1-E15. Likewise, the receivers 62 are individually positioned lengthwise along the distal end 68 and are identified by references R1-R15. In the preferred embodiment, the total number of emitters 60 in the proximal end 66 is equal to the total number of receivers 62 in the distal end 68 and each individual emitter 60 (i.e., E1-E15) is directly aligned across the top surface 64 and corresponds with an individual receiver 62 (i.e., R1-R15). In this manner and as described in more detail below, a light beam 76 is created across the top surface 64 of the platform 56 for each light that is emitted from an emitter 60 and received by a correspondingly aligned receiver 62.

Figure 3:
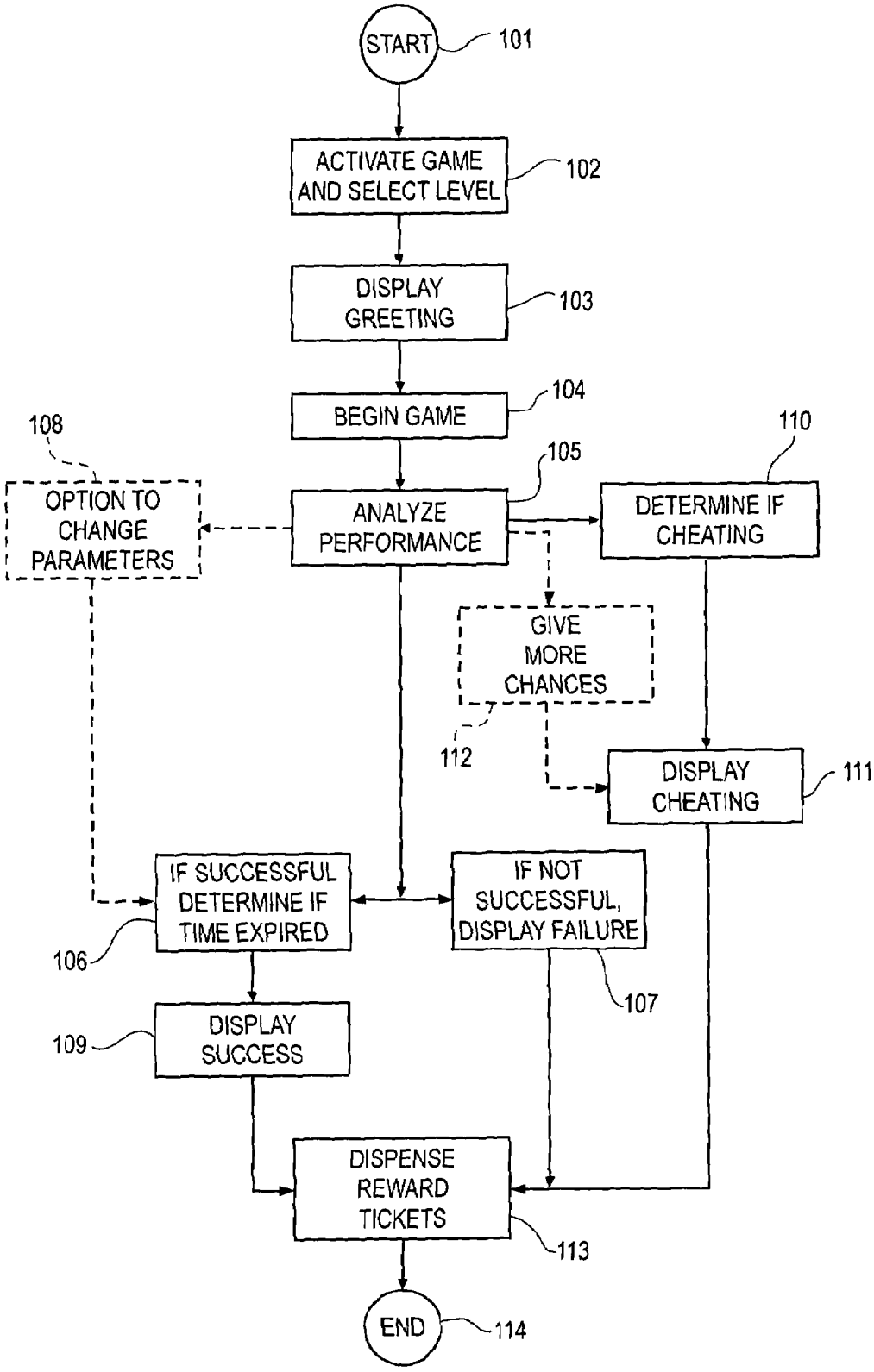
FIG. 3 is a flow chart of the basic operation of the electronic jump rope device.

Turning to FIG. 3, there is illustrated a flow chart of the basic operation of electronic jump rope device 20.

In Step 101, if the process for starting or beginning the operation of the jump rope device 20 is to begin or be launched, proceed to Step 102. For ease of reference, the operation of the jump rope device 20 is also referred to herein as a "game."

In Step 102, to begin or activate the jump rope device 20 or game, a user 74 deposits a coin or coins into the coin slot 44 in the game activated mechanism 30. In the preferred embodiment, the coins may be any type or amount of coins or currency desired. Alternatively, it is contemplated that the game activated mechanism 30 may accept any type of coin, paper currency, credit or other type of plastic card, or any other type of payment known to one of ordinary skill in the art.

When the required coins or currency is inserted into the coin slot 44 and received into the game activated mechanism 30, the game activated mechanism 30 proceeds to validate and accept the currency. If the currency is accepted, the game is activated and the game selection display 32 illuminates. This informs the user 74 that the game is activated. The first level of difficulty is the default mode and automatically selected. The user has the option to select a higher level of difficulty. This is done by pressing one of the game selection display buttons, 33 or 35. The appropriate game selection display 33 or 35 becomes illuminated. This informs the user 74 that level 2 or level 3 of the game has been selected. When completed, proceed to Step 103.

Alternatively, as is well known to one skilled in the art, it is contemplated that the game may be started or activated through the toggling of a switch between an on/off position and the levels may be selected by a button control which enables the user 74 to scroll through the various levels and select the one desired. This mode of operation is more appropriate in a health club or home environment where coins or currency are not required to activate the game.

In Step 103, upon starting the game and selecting the appropriate level of the game to play, the message display 34 on the display board unit 24 displays a greeting. In a non-limiting example as depicted in FIG. 1, the greeting is "Welcome." Alternatively, the greeting may be any desired greeting displayed in the message display 34, any voice or other audio outputted from the speakers 42, or any combination of both. When completed, proceed to Step 104.

In Step 104, the game begins. In the preferred embodiment, a time delay is provided between when the greeting is displayed and the game begins. The time delay is preferably any time less than five (5) seconds. In this manner, the time delay enables the user 74 to position themselves on the top surface 64 of the platform 56 and get ready for the game to begin. Alternatively, in addition to the time delay, the message display 34 may display a message or the speakers 42 may produce any voice or other audio output such as "Game will begin in five (5) seconds", and then provide a message countdown "5", "4", "3", "2", "1", "Begin." In another alternative, the string of lights 54 may all be simultaneously illuminated forming a single light to signal to the user 74 that the game is about to begin. In yet another alternative, it is contemplated that any combination of the message display 34, the speakers 42, and the string of lights 54 may be used during the time delay to notify the user 74 of when the game is to begin.

When the game begins, the individual strings of lights 50 are pre-programmed to coact with one another by illuminating on and off in a timed sequence around the entire perimeter of the housing 22 for simulating a jump rope in action. In a non-limiting example, the illumination may either be in the clockwise or counter-clockwise direction. Assuming for purposes of this example a clockwise direction, the game will begin as follows.

Referring back to FIG. 2, the first individual string of lights 50 to be illuminated will be the string of lights identified by reference L1. In the preferred embodiment, the illumination of the first individual string of lights 50 includes all of the individual lights 54 contained within this string. After the first string of lights 50 identified by reference L1 is illuminated for the desired pre-programmed timed sequence, the adjacent string of lights 50 to the clockwise left of string of lights L1 will be illuminated next. This string of lights 50 is identified by reference L2. When this occurs, the illumination of the string of lights 50 identified by reference L1 may be completely turned off. Alternatively, the illumination of this string of lights 50 may be gradually turned off or cooled such as through the use of a dimmer circuit known to one skilled in the art. After this string of lights 50 identified by reference L2 is illuminated for the desired timed sequence, the adjacent string of lights 50 to the clockwise left of string of lights L2 will be illuminated next. This string of lights 50 is identified by reference L3. When this occurs, the illumination of the string of lights 50 identified by reference L2 may be completely turned off or the illumination of this string of lights 50 may be gradually turned off or cooled. If the illumination is completely turned off, string of lights 50 identified by references L1 and L2 will be completed turned off and string of lights 50 identified by reference L3 will be the only string of lights 50 illuminated at this time. If the illumination of the string of lights 50 is to be gradually turned off or cooled, the string of lights 50 identified by reference L1 and L2 will each be dimmed or, in other words, providing an illumination that is less than the full illumination provided by the string of lights 50 identified by reference L3. Additionally, the string of lights 50 identified by reference L1 will likewise be providing an illumination that is less than the string of lights 50 identified by reference L2. In this manner, the full illumination of the current string of lights 50 (currently identified by reference L3) and the successive gradual reduction in the intensity of the illumination of each previous string of lights 50 creates or simulates the visual rotational flow of the jump rope as it rotates or turns around the perimeter of the housing 22. The illumination process for the string of lights 50 continues in this manner for each successive string of lights 50 around the entire perimeter of the housing 22. A complete rotation will occur when all of the strings of lights 50 have been illuminated and the string of lights 50 identified by reference L1 is again illuminated in the rotation. Before a complete rotation is accomplished, proceed to Step 105.

In Step 105, the performance of the user 74 is analyzed. When the string of lights 50 identified by reference L57 (i.e., this is the fifty-seventh string of lights 50 in the successive clockwise rotation) becomes illuminated, the analysis of the performance begins. In the preferred embodiment, the string of lights 50 identified by reference L57 is electrically connected to at least one of the two emitters 60 on the platform 56 identified by references E1 and E2. When the string of lights 50 identified by reference L57 illuminates, a light beam 76 is emitted from emitters 60 identified by references E1 and E2 and sent across the top surface 64 of the platform 56 to the receivers 62 identified by references R1 and R2, respectively.

Likewise, when the adjacent string of lights 50 to the clockwise left of the string of lights L57 becomes illuminated in the time sequence, this next string of lights 50, identified by reference L58, is electrically connected to at least one of the two emitters 60 identified by references E3 and E4. When this string of lights 50 becomes illuminated, a light beam 76 from emitters 60 identified by references E3 and E4 is sent across the top surface 64 of the platform 56 to the receivers 62 identified by references R3 and R4, respectively.

As the illumination of the string of lights 50 continues through each successive string of lights 50 until it reaches the string of lights 50 identified by reference L64 (i.e., the last string of lights at the end of a full rotation), light beams 76 continue to be emitted, in successive order, across the top surface 64 of the platform 56. In the preferred embodiment, the timed sequential illumination of the string of lights 50 (identified by references L57 through L64) will occur simultaneously with and trigger each corresponding light beam 76 emitted from emitters 60 (identified by references E1 through E16) to receivers 62 (identified by references R1 through R16). In this manner, the illumination of the individual strings of lights 50 are electrically connected to their respective associated light beam 76 which simulates the natural rotation and path of the jump rope as it passes over the platform 56.

There are other variations and means to synchronize the string of lights to a particular emitter and its corresponding receiver. For example, the emitters can be sequenced one at a time. The controller asynchronously scans the platform sensors and periodically sends the active status serially to the controller. The sensor status only needs to be tested when the corresponding light rope is lit. In this manner the controller determines if the user is breaking the light beam 76 at the inappropriate time signaling that the user unsuccessfully jumped over the rope. Another platform 56 that could be used is a pressure or weight sensitive platform that detects the presence or absence of the user. The signal generated by the user 74 on the platform would be synchronized with the rotation of the string of lights 50. Other methods of determining if a user 74 successfully jumped over the rope will be apparent to one skilled in the art.

During the illumination of any of the individual strings of lights 50 identified by references L57 through L64, when the corresponding light beams 76 are emitted, the user 74 must not block the light beams 76 from being received by the corresponding receivers 62. As such, the user 74 must have jumped prior to these light beams 76 being emitted and be sufficiently above the light beam 76 when emitted or be in a position on either the left side or right side of the light beam 76 to avoid blocking these light beams 76. If the user 74 avoids all of the light beams 76 that pass over the top surface 64 of the platform 56 as the string of lights 50 passes by during the first rotation, the user 74 is successful on the first jump. If this occurs, proceed to Step 106. If the user 74 does not avoid all of the light beams 76 or, in other words, blocks any one of the light beams 76 that pass over the top surface 64 of the platform 56 (e.g., such as by their foot), the user 74 has not been successful or has failed the first jump. If this occurs, proceed to Step 107.

In Step 106, if the user 74 is successful on the first jump or, alternatively, on any selected number of jumps per chosen game level, a determination of the amount of time remaining for the game is made. If the Time remaining for the game has not yet expired, proceed back to Step 105 and continue the game. As an option or alternative embodiment, if the Time remaining for the game has not yet expired, proceed to Step 108. If, on the other hand, the Time for the game has expired, proceed to Step 109.

In Step 108, the parameters of the game for the level selected are optionally changed. In a non-limiting example, the speed of the jump rope for each rope rotation or turn ("Speed of Rope Turn") can be increased, the total number of jump rope rotation or turns ("Number of Rope Turns") can be increased, a second jump rope can be added for rotation in the same direction as the first rope with each rope separated in the rotation by a pre-determined amount of time or spacing, or alternatively, the second jump rope can be added for rotation in the opposite direction as the first rope (e.g., which is often referred to as "Double Dutch"), or any other type of performance enhancer that can assist in making the game harder or more difficult for the user 74. In yet another alternative, it is contemplated that a button may be provided to allow the user 74 to manually increase the Speed of the Rope, Number of Rope Turns, or change other desired parameters. When the parameters of the game are changed, proceed back to Step 105 and continue the game with the new parameters.

In Step 109, when the Time for the game has expired and the user 74 has been successful in the level of the game played, the message display 34 may display a message or the speakers 42 may produce any voice or other audio output such as "Congratulations. You Win!" In another alternative, the string of lights 54 may all be simultaneously illuminated forming a single light to signal to the user 74 a successful completion of the game. In yet another alternative, it is contemplated that any combination of the message display 34, the speakers 42, and the string of lights 54 may be used in any manner to notify the user 74 of a successful completion of the game. When completed, proceed to Step 113.

In Step 107, if the user 74 is not successful on the first jump or, alternatively, on any selected number of jumps per chosen game level, the message display 34 may display a message or the speakers 42 may produce any voice or other audio output such as "Sorry. You Lose!" In another alternative, the string of lights 54 may all be simultaneously de-illuminated or turned off to signal to the user 74 an unsuccessful completion of the game. In yet another alternative, it is contemplated that any combination of the message display 34, the speakers 42, and the string of lights 54 may be used in any manner to notify the user 74 of an unsuccessful completion of the game. When completed, proceed to Step 113.

While the operation of the game being played in Steps 105 through 109, Step 110 is also simultaneously occurring. In this Step 110, a monitoring means is used to determine whether the user 74 may be cheating at any point during the game. In the preferred embodiment, a timing circuit and the light beams 76 or, alternatively, a foot sensor are used to determine the presence or absence of the user 74 on the platform 56. Although the light beams 76 are used in different phases to analyze the performance of the user 74, a circuit may also enable all the light beams 76 to be constantly active to register when the user 74 is blocking any one of the light beams 76 to determine the presence or absence of the user 74 on the platform 56. The default time for the timing circuit is six hundred (600) milliseconds. Accordingly, if at any time, the presence of the user 74 is not registered on the top surface 64 of the platform 56 for more than the default time, the user 74 is determined to be cheating. Or, in other words, if the user 74 has jumped off the top surface 64 of the platform 56 (i.e, to presumably avoid a light beam 76) and more than the default time (e.g., more than six hundred (600) milliseconds) has elapsed since the user 74 is registered as having returned back to the top surface 64 of the platform 56, the user 74 is assumed to be cheating. The reason is that if this default time has elapsed, the user 74 is presumed to have jumped off the platform 56 and is standing next to the platform 56 waiting for the light beams 76 to pass. If this occurs and the user 74 is determined to be cheating, proceed to Step 111.

If, on the other hand, the user 74 has jumped off the top surface 64 of the platform 56 (i.e, to presumably avoid a light beam 76) and less than the default time (e.g., less than six hundred (600) milliseconds) has elapsed before the user 74 is registered as having returned back to the top surface 64 of the platform 56, the user 74 is found to be in compliance. The reason is that if this default time has not elapsed, the user 74 is presumed to have continued to remain on the platform 56 and is playing the game correctly. If this occurs, no further action is taken and proceed back to Step 105 where the game continues. This Step 110 will continue until Steps 105 through 109 are completed.

In Step 111, if the user 74 is determined to be cheating, the message display 34 may display a message or the speakers 42 may produce any voice of other audio output such as "Stop. No Cheating Allowed. Game Ended." In another alternative, the string of lights 54 may all be simultaneously de-illuminated or turned off to signal to the user 74 the stopping of the game. In yet another alternative, it is contemplated that any combination of the message display 34, the speakers 42, and the string of lights 54 may be used in any manner to notify the user 74 of the stopping of the game. When completed, proceed to Step 113. Alternatively, if the user 74 is determined to be cheating, proceed to Step 112.

In Step 112, even though the user 74 is determined to be cheating, the user 74 can be given additional chances to redeem themselves. In this alternate step, if additional chances are provided, the message display 34 may display a message or the speakers 42 may produce any voice or other audio output such as "Stop. No Cheating Allowed. Return to Platform." In another alternative, the string of lights 54 may all be simultaneously de-illuminated or turned off to signal to the user 74 to return to the platform 56 to continue the game. In yet another alternative, it is contemplated that any combination of the message display 34, the speakers 42, and the string of lights 54 may be used in any manner to notify the user 74 to stop cheating and to return to the platform 56 so that the game may be continued. When completed, proceed back to Step 105 and continue the game.

In Step 113, depending upon the performance of the user 74 during the game, a determination is made as to how many paper tickets or other reward the user 74 has won. If the user 74 was successful on all the jumps and won the game, they would be entitled to a larger or better reward than if they were partly successful but had failed to win, or if they failed completely, or if they were found cheating. Once the reward for performance is determined, in the preferred embodiment, the ticket dispenser 48 will dispense the appropriate number or amount of reward tickets. When completed, proceed to Step 114 where the game is ended.

Figure 4C:
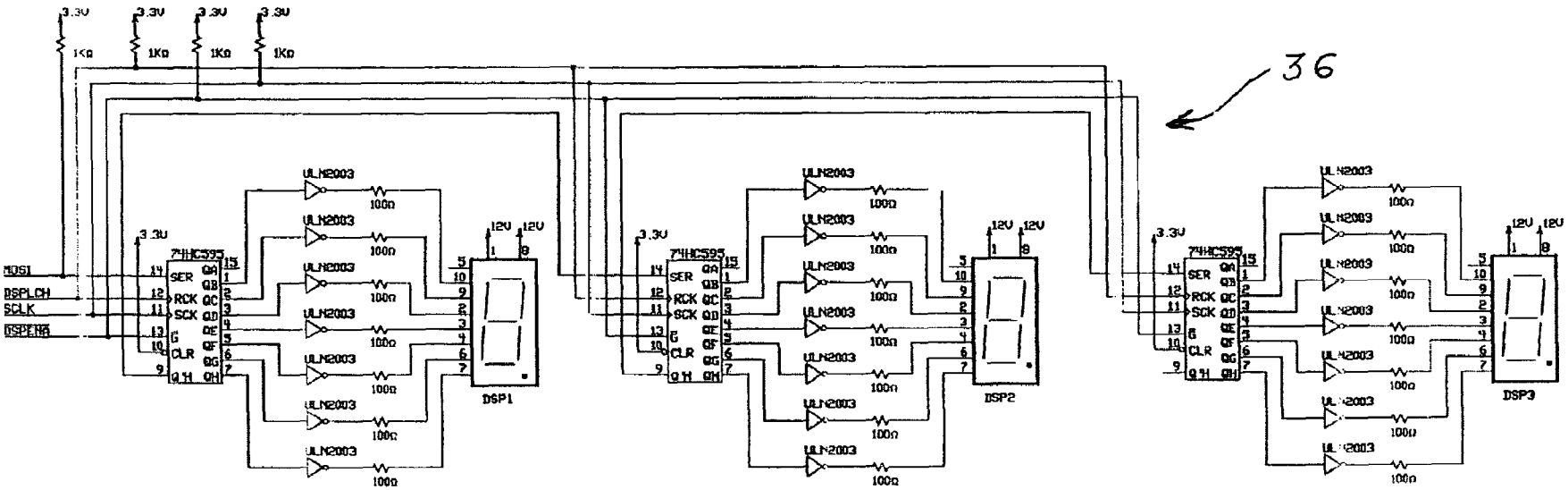
Figure 4D:
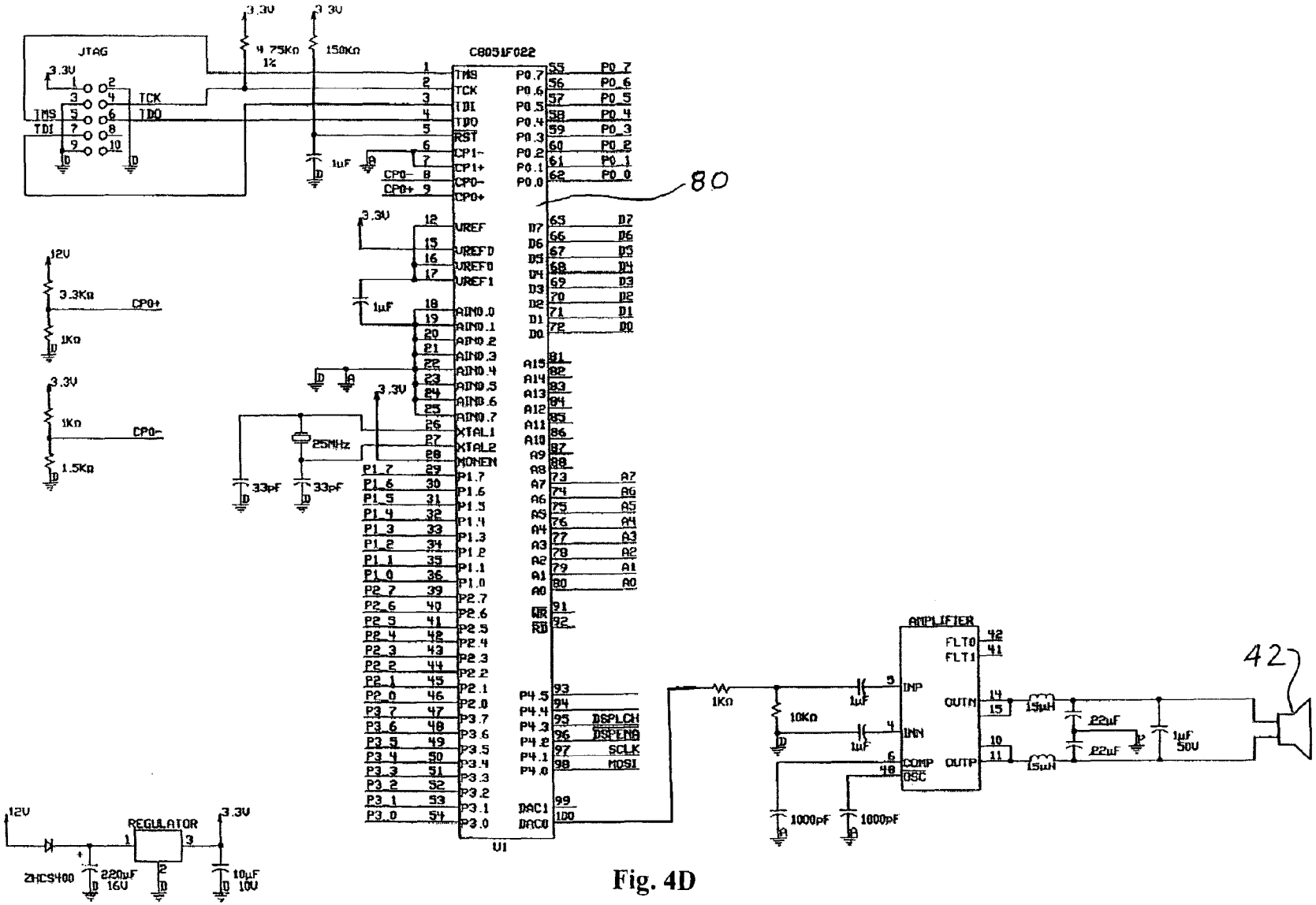

The electronic schematic of several components are illustrated in FIGS. 4A-4D. FIG. 4A shows thirty-two strings of lights 50, whereas the actual production units utilize sixty-four individual strings of lights to better visualize the concept of a moving jump rope. Inputs P0_1 through P3_7 of the strings of lights 50 are connected to a their respective outputs of a microprocessor 80, illustrated in FIG. 4D. FIG. 4D also illustrates the speaker 42 and its respective circuitry connected to the microprocessor 80.

FIG. 4B is a schematic diagram of the platform 56 and the emitters 60 and receivers 62. The emitters illustrated as E1-E8 with inputs A0 to A7 emit light to the receivers 62 illustrated respectively as R-1 to R-8 with outputs D0 to D7. The respective input and outputs are connected to microprocessor 80. This controls determining if the user is on or off the platform 56 at the proper time in the jump sequence. The schematic only illustrates eight emitters and receivers when in the preferred embodiment, there are fifteen of each.

FIG. 4C illustrates the score/timer display 36 circuitry that is connected to the microprocessor and can be programmed to display the time played, time remaining to be played, or the score achieved by the user for successfully jumping over the rope during play. There are three illuminated outputs or numerals shown in FIGS. 1 and 4C. However, more or less numerals can be used. They can be programmed to alternately display the remaining or expired time and score, or continuously display any of these items.

Thus, there has been provided a unique electronic jump rope device. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. An electronic gaming device in which a user is suppose to jump in response to the illumination of a light, comprising:

a housing having at least a top, a bottom, and opposite sides;

a plurality of lights mounted on the housing for providing a continuous light path in a loop around the top, sides, and bottom;

a platform having a top surface, the platform disposed adjacent to the bottom of the housing;

a controller for selectively illuminating at least some of the plurality of lights along the continuous light path to simulate a jump rope; and a plurality of sensors on the platform, each sensor comprising an emitter mounted on a first part of the platform and a receiver mounted on a second part of the platform separated from the first part of the platform and a signal is transmitted between the emitter and receiver, and wherein the area between the emitter and the receiver is the area on the top surface where the user is to stand and jump; and means for electrically connecting each emitter and corresponding receiver to an aligned light at the bottom of the housing for determining if the user is on the top surface of the platform between the emitter and its corresponding receiver when the aligned light at the bottom of the housing is illuminated.

2. The electronic gaming device of claim 1 and further comprising means for stopping the illuminating of the plurality of lights if the user is on the top surface of the platform when the at least one of the plurality of lights is illuminated at the predetermined location on the bottom of the housing.

3. The electronic gaming device of claim 1 wherein the controller selectively illuminates the plurality of lights sequentially along the continuous light path.

4. The electronic gaming device of claim 1 wherein the means for determining if a user is on the top surface of the platform comprises a weight sensor within in the platform.

5. The electronic gaming device of claim 1 wherein the means for determining if a user is on the top surface of the platform comprises a plurality of sensors on the platform.

6. The electronic gaming device of claim 5 wherein the plurality of sensors are each comprised of an emitter mounted on a first part of the platform and a receiver mounted on a second part of the platform separated from the first part of the platform and a signal is transmitted between the emitter and receiver, and wherein the area between the emitter and the receiver is the area on the top surface where the user is to stand and jump.

7. The electronic gaming device of claim 6 and further comprising scoring means that increments each time the user jumps off the platform when the at least one of the plurality of lights is illuminated at the predetermined location on the bottom of the housing.

8. The electronic gaming device of claim 6 and further comprising means for electrically connecting a specific emitter and receiver pair to an aligned light at the bottom of the housing for determining if the user is on the top surface of the platform between the specific emitter and its respective receiver when the aligned light at the bottom of the housing is illuminated.

9. The electronic gaming device of claim 8 and further comprising means for stopping the sequential illumination of the plurality of lights if the signal between the emitter and receiver is broken when its respective aligned light at the bottom of the housing is illuminated.

10. The electronic gaming device of claim 1 and further comprising timing means for determining if the user is off the platform for more than a predetermined time.

11. The electronic gaming device of claim 10 where the timing means for determining if the user is off the platform for more than a predetermined time comprises at least one sensor on the platform for detecting the presence of the user, the sensor transmitting a signal to the controller, and a means for connecting the sensor to the controller.

12. The electronic gaming device of claim 11 wherein the means for connecting the sensor to the controller comprises a hard wired electrical connection.

13. An electronic gaming device in which a user jumps in response to the illumination of one or more lights comprising:

a housing with a bottom portion resting on the ground;

a plurality of lights mounted about the perimeter of the housing, the plurality of lights defining a continuous light path in a loop around the perimeter of the housing; means for sequentially illuminating the plurality of lights along the continuous light path to simulate a jump rope;

a jump area disposed in front of the bottom portion;

a sensor mounted in the jump area for detecting the presence of the user in the jump area;

means for determining if the user is present in the jump area when the plurality of lights are illuminated at predetermined locations along the bottom portion of the housing; and means for stopping the illumination of the plurality of lights if the user is present in the jump area when the plurality of lights are illuminated at the predetermined locations along the bottom of the housing signifying that the user did not jump above the jump area when the plurality of lights are sequentially illuminated along the bottom portion of the housing.

14. The electronic gaming device of claim 13, wherein the means for sequentially illuminating the plurality of lights, and the means for determining if the user is present in the jump area when the plurality of lights are illuminated at predetermined locations along the bottom of the housing comprises a controller.

15. The electronic device of claim 14 wherein the means for determining if the user is present in the jump area when the plurality of lights are illuminated at predetermined locations along the bottom of the housing further comprises a sensor.

16. The electronic device of claim 15 wherein the sensor means comprises an emitter mounted on a first part of a frame surrounding the jump area and a receiver mounted on a second part of the frame separated from the first part of the frame and a signal transmitted between the emitter and receiver, and wherein the area between the emitter and the receiver is the jump area where the user is to stand and jump.

17. The electronic gaming device of claim 16 and further comprising means for electrically connecting a specific emitter and receiver pair to an aligned light at the bottom of the housing for determining if the person is in the jump area between the specific emitter and its respective receiver when the aligned light at the bottom of the housing is illuminated.

18. The electronic gaming device of claim 17 and further comprising means for stopping the illumination of the plurality of lights if the signal between the emitter and receiver is broken when its respective aligned light at the bottom of the housing is illuminated.

* * * * *

UNITED STATES PATENT AND TRADEMARK OFFICE

CERTIFICATE OF CORRECTION

PATENT NO. : 8,123,586 B2
APPLICATION NO. : 11/796864
DATED : February 28, 2012
INVENTOR(S) : George Dell It is certified that error appears in the above-identified patent and that said Letters Patent is hereby corrected as shown below:

Claim 4 - Delete

Claim 5 - Delete

Claim 6 - Delete

Claim 7 - Replace “6” with -- 1 --.

Claim 8 - Delete

Claim 9 - Replace “8” with -- 1 --.

Signed and Sealed this
First Day of May, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,123,586 B2
APPLICATION NO. : 11/796864
DATED : February 28, 2012
INVENTOR(S) : George Dell It is certified that error appears in the above-identified patent and that said Letters Patent is hereby corrected as shown below:

Delete the title page and substitute therefore the attached title page showing the corrected number of claims in patent.

Column 9, lines 27-41, delete claims 4-6.

Claim 7 - Replace "6" with -- 1 --.

Column 9, lines 47-53, delete claim 8.

Claim 9 - Replace "8" with -- 1 --.

This certificate supersedes the Certificate of Correction issued May 1, 2012.

Signed and Sealed this
Twenty-ninth Day of May, 2012

David J. Kappos

David J. Kappos
*Director of the United States Patent and Trademark Office*

(12) United States Patent
Dell

(10) Patent No.: US 8,123,586 B2
(45) Date of Patent: Feb. 28, 2012

(54) ELECTRONIC JUMP ROPE

(75) Inventor: George Dell, Grayslake, IL (US)

(73) Assignee: Dell Electronics Laboratories, Ltd., Grayslake, IL (US)

( * ) Notice: Subject to any disclaimer, the term of this patent is extended or adjusted under 35 U.S.C. 154(b) by 1087 days.

(21) Appl. No.: 11/796,864

(22) Filed: Apr. 28, 2007

(65) Prior Publication Data

US 2008/0268949 A1 Oct. 30, 2008

(51) Int. Cl.
*A63H 1/00* (2006.01)

(52) U.S. Cl. ..... 446/236; 463/7; 482/54

(58) Field of Classification Search ..... 463/1, 31; 446/236; 473/414; 84/743; 482/54
See application file for complete search history.

(56) References Cited

U.S. PATENT DOCUMENTS

| | | | | |
|---|---|---|---|---|
| 5,839,976 | A * | 11/1998 | Darr | 473/414 |
| 6,001,013 | A * | 12/1999 | Ota | 463/7 |
| 6,227,968 | B1 * | 5/2001 | Suzuki et al. | 463/7 |
| 6,450,888 | B1 * | 9/2002 | Takase et al. | 463/43 |
| 6,554,706 | B2 * | 4/2003 | Kim et al. | 463/36 |
| 6,663,491 | B2 * | 12/2003 | Watabe et al. | 463/36 |
| 6,835,887 | B2 * | 12/2004 | Devecka | 84/743 |
| 7,367,887 | B2 * | 5/2008 | Watabe et al. | 463/36 |
| 2005/0255787 | A1 * | 11/2005 | Pak | 446/236 |
| 2006/0142127 | A1 * | 6/2006 | Wilkins et al. | 482/54 |
| 2007/0032353 | A1 * | 2/2007 | Wilkins et al. | 482/54 |

OTHER PUBLICATIONS

Jumpin Jackpot Manual Dated Nov. 2006 with the attached Picture.*

* cited by examiner

*Primary Examiner* Masud Aluned
(74) *Attorney, Agent, or Firm* -- Knechtel, Demeur & Samlan

(57) ABSTRACT

An exercise gaming device in which the user stands in front of a housing having a plurality of rows of lights extending from the front of the housing to the rear of the housing. The rows of lights are sequentially illuminated to give the illusion that the lights are an illuminated light rope over which the user must jump. There is a sensor in the jump area that is electrically connected to the illuminated lights to determine if the user jumps at the correct time when the lights at the bottom of the housing are illuminated. The device continues to rotate the light rope as long as the user continues jumping at the appropriate time, or until the game ends.

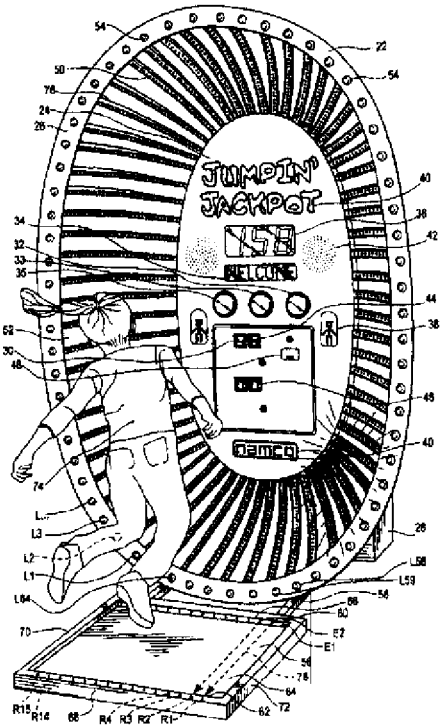

14 Claims, 6 Drawing Sheets